US008132983B2

(12) United States Patent
Lutz et al.

(10) Patent No.: US 8,132,983 B2
(45) Date of Patent: Mar. 13, 2012

(54) RIDING CONCRETE TROWEL WITH STABILIZERS

(75) Inventors: Todd J. Lutz, Oconomowoc, WI (US); Richard D. Goldberg, Hartford, WI (US)

(73) Assignee: Wacker Neuson Production Americas LLC, Menomonee Falls, WI (US)

( * ) Notice: Subject to any disclaimer, the term of this patent is extended or adjusted under 35 U.S.C. 154(b) by 386 days.

(21) Appl. No.: 12/349,666

(22) Filed: Jan. 7, 2009

(65) Prior Publication Data

US 2009/0185860 A1 Jul. 23, 2009

Related U.S. Application Data

(60) Provisional application No. 61/022,050, filed on Jan. 18, 2008.

(51) Int. Cl.
*E01C 19/00* (2006.01)

(52) U.S. Cl. ..... 404/112

(58) Field of Classification Search ..... 404/112
See application file for complete search history.

(56) References Cited

U.S. PATENT DOCUMENTS

| | | | | |
|---|---|---|---|---|
| 2,826,972 | A | 3/1958 | Stevens | |
| 4,046,484 | A | 9/1977 | Holz, Sr. et al. | |
| 5,108,220 | A | 4/1992 | Allen et al. | |
| 5,685,667 | A | 11/1997 | Allen | |
| 5,816,739 | A * | 10/1998 | Allen | 404/112 |
| 5,967,696 | A * | 10/1999 | Allen et al. | 404/112 |
| 6,368,016 | B1 | 4/2002 | Smith et al. | |
| 6,592,290 | B2 | 7/2003 | Jaszkowiak | |
| 7,172,365 | B2 | 2/2007 | Lutz et al. | |
| 7,207,745 | B2 * | 4/2007 | Goossens | 404/112 |
| 7,775,740 | B2 * | 8/2010 | Berritta | 404/112 |

OTHER PUBLICATIONS

U.S. Appl. No. 11/782,844, filed Jul. 25, 2007; Title: Concrete Trowel Steering System; Inventor(s): Roberto Berritta; specification (17); claims (20); drawings (12); abstract (1).

European Search Report Dated Mar. 5, 2010 for EP 09 00 0581.

* cited by examiner

*Primary Examiner* — Gary S Hartmann
(74) *Attorney, Agent, or Firm* — Boyle Fredrickson, S.C.

(57) ABSTRACT

In a riding concrete finishing trowel, a stabilizer is operatively disposed between the frame and either the gearbox or a structure that is coupled to the gearbox so as reduce the effects of rotor assembly vibration on the trowel. In one embodiment, the stabilizer takes the form of a gas spring located between the frame and the pitch control post. The stabilizer may be located relatively close to the top of the pitch control post so as to take advantage of the mechanical advantage offered by the spacing between that location and the gearbox.

21 Claims, 6 Drawing Sheets

RIDING CONCRETE TROWEL WITH STABILIZERS

CROSS-REFERENCE TO RELATED APPLICATION

This application claims priority under 35 U.S.C. §119(e) to U.S. Provisional Application Ser. No. 61/022,050, filed Jan. 18, 2008, entitled RIDING CONCRETE TROWEL WITH STABILIZERS, the contents of which are hereby incorporated by reference in their entirety.

BACKGROUND OF THE INVENTION

1. Field of the Invention

The invention relates generally to concrete finishing trowels and, more particularly, to finishing trowels that support an operator during use, i.e. riding trowels, with stabilizers for mitigating the effects of vibrations on trowel operation.

2. Description of the Related Art

A variety of machines are available for smoothing or otherwise finishing wet concrete. These machines range from simple hand trowels, to walk-behind trowels, to self-propelled riding trowels. Regardless of the mode of operation of such trowels, the powered trowels generally include one to three rotors that rotate relative to the concrete surface. Riding finishing trowels can finish large sections of concrete more rapidly and efficiently than manually pushed or guided hand-held or walk behind finishing trowels. The present invention is directed to riding finishing trowels.

More particularly, the invention relates to a concrete finishing trowel, such as a riding trowel, having rotor assemblies that can be tilted for a steering operation. Riding concrete finishing trowels of this type typically include a frame having a cage that generally encloses two, and sometimes three or more, rotor assemblies. Each rotor assembly includes a driven shaft and a plurality of trowel blades mounted on and extending radially outwardly from the bottom end of the driven shaft. The driven shafts of the rotor assemblies are driven by one or more engines mounted on the frame and typically linked to the driven shafts by gearboxes of the respective rotor assemblies.

The weight of the finishing trowel, including the operator, is transmitted frictionally to the concrete surface by the rotating blades, thereby smoothing the concrete surface. The pitch of individual blades can altered relative to the driven shafts via operation of a lever and/or linkage system during use of the machine. Such a construction allows the operator to adjust blade pitch during operation of the power trowel, typically by operating a crank mounted on a pitch control post and connected to the rotor assembly. As commonly understood, blade pitch adjustment alters the pressure applied to the surface being finished by the machine. This blade pitch adjustment permits the finishing characteristics of the machine to be adjusted. For instance, in an ideal finishing operation, the operator first performs an initial "floating" operation in which the blades are operated at low speeds (on the order of about 30 rpm) but at high torque. Then, the concrete is allowed to cure for another 15 minutes to one-half hour, and the machine is operated at progressively increasing speeds and progressively increasing blade pitches up to the performance of a finishing or "burning" operation at the highest possible speed—preferably above about 150 rpm and up to about 200 rpm.

The rotor assemblies of riding trowels also can be tilted relative to the vertical for steering purposes. By tilting the rotor assemblies, the operator can utilize the frictional forces imposed on the blades by the concrete surface to propel the vehicle. Generally, the vehicle will travel in a direction perpendicular to the direction of tilt of the driven shaft. Specifically, tilting the rotor assembly from side-to-side and fore-and-aft steers the vehicle in the forward/reverse and the left/right directions, respectively. It is also commonly understood that, in the case of a riding trowel having two rotor assemblies, the driven shafts of both rotor assemblies should be tiltable side-to-side for forward/reverse steering control, whereas only the driven shaft of one of the rotor assemblies needs to be tilted fore and aft for left/right steering control.

One problem experienced by all riding finishing trowels to one extent or another is undesired vibrations resulting from sliding contact between the rotating blades and the surface being finished. The causes of these vibrations are not completely understood. Nor is it fully understood why some sizes or brands of machines are more susceptible to these vibrations than others or why some abatement techniques are more effective than others. However, it is generally known that at least a major contributing factor to these vibrations is so-called "stick-slip vibration," sometimes known as "chatter." Stick-slip vibration is characterized by a saw-tooth wave of periodic cycles of motion and arrests and sometimes occurs between slowly moving bodies in dry or boundary lubricated sliding contact. When the moving body has a large contact surface, the stick-slip phenomenon is complex, especially when the body is rotating, due to the fact of the tangential velocity at a point in the surface varies with the radial distance from the axis of rotation. The distribution of the normal load over the surface also varies the multi-point loading pattern of the wake of the system over the rotating body. Chatter tends to increase with coefficients of friction and to decrease with contact pressure.

Generally speaking, midsize trowels such as 48" trowels, i.e., those finishing a swath of the order of about 48", are more susceptible to chatter than in 36" trowels and 60" trowels. Chatter tends to be the most pronounced when steel blades are employed rather than composite blades and blade pitch is set to be relatively flat—on the order of 0-5°. Chatter is also more pronounced when the coefficient of friction of the curing concrete is at a maximum, which occurs when the concrete is partially set but still has some viscosity. In addition, in any given trowel design, the vibrations tend to occur predictably at multiple, but repeatable on a cycle-by-cycle basis, rotor assembly RPMs. For instance, as a 48" trowel accelerates from 0 to 150 rpms, it may experience chatter at 60, 100, and 125 rpm at a given blade pitch on a surface with a given coefficient of friction. These vibrations can become so severe in some machines that the entire machine "hops" up-and-down and side-to-side, resulting in considerable operator discomfort and, in some cases, marring of the concrete by the vibrating blades. Depending upon the make and size of the trowel, these vibrations can result in oscillation of the top of the pitch control post of 2" or more. These effects could be reduced by increasing blade pitch to increase pressure, but that is not an option on relatively soft concrete or concrete having imbedded fibers that might be cut by or snagged on a highly-pitched blade In any mechanical system, vibrations can be reduced by increasing the system's stiffness (hence increasing its spring constant), or damping the system. Prior attempts to reduce chatter focused primarily on increasing the system's stiffness. For instance, Whitemen reduced chatter in its finishing machine, as measured by oscillation of its pitch control posts, to about 1.5", presumably by maximizing the stiffness of its frame and other trowel components. However, these measures came at the costs of increased weight and expense and would require a substantial redesign of other trowels. Blades made of composite plastics have also been introduced and have been quite effective at reducing chatter because they have a much lower spring constant than traditional steel blades as well as a lower coefficient of friction. However, these blades are substantially more expensive than steel blades and have met with limited industry acceptance.

Accordingly, there is a need for a ride-on concrete finishing trowel that experiences less vibrations during operation than traditional ride-on concrete finishing trowels.

The need also exists to provide a stabilizing system for a ride-on concrete finishing trowel that is non-intrusive and simple and inexpensive to construct and install.

SUMMARY OF THE INVENTION

The present invention provides a power concrete finishing trowel that overcomes one or more of the above-mentioned drawbacks. In accordance with a first aspect of the invention, a stabilizer is operatively disposed between the frame and either the gearbox or a structure that is coupled to the gearbox. Such a stabilizer has been found to reduce the effects of rotor vibration on the trowel more than would be expected and even to improve steering response. In one embodiment, the stabilizer takes the form of a dampener, preferably a gas spring located between the frame and the pitch control post. Preferably, this gas spring is located relatively close to the top of the pitch control post so as to take advantage of the mechanical advantage offered by the spacing between that location and the gearbox.

In accordance with another aspect of the invention, a method is provided that includes reducing the transmission of vibrations from a riding trowel gearbox to the trowel's frame. This dampening preferably is performed using a gas spring and also improves steering response.

These and other aspects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof. It is hereby disclosed that the invention include all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

Figure 1:
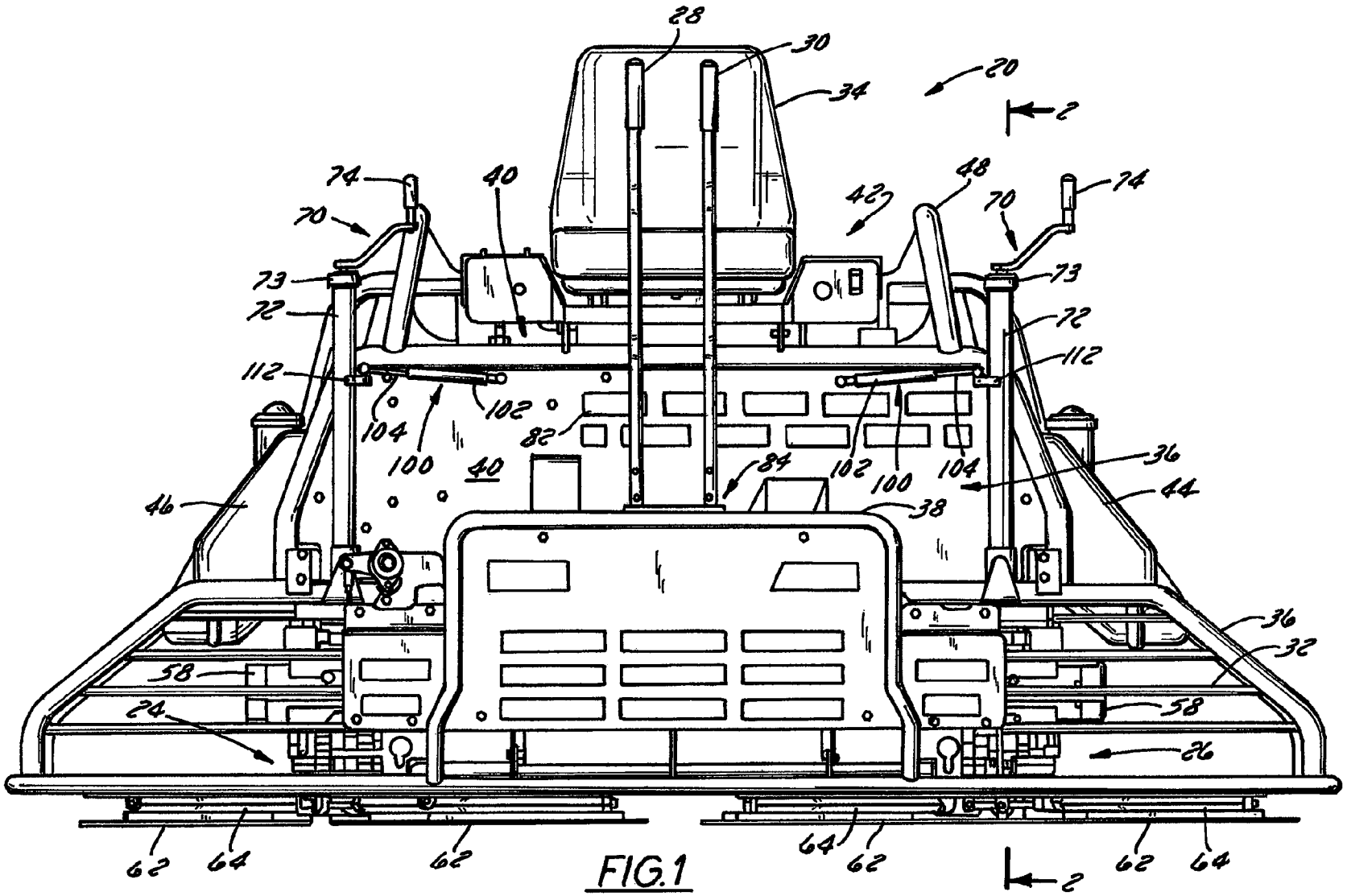
FIG. 1 is a front elevational view of a riding power concrete finishing trowel equipped with stabilizers in accordance with the present invention.

FIG. 1 shows a self-propelled riding concrete finishing trowel 20 equipped with stabilizers 100 according to present invention. The trowel 20 includes a steering system 22 steers machine 20 by tilting the driven shafts of the rotor assemblies 24, 26 of machine 20 without requiring the imposition of fatiguing actuating forces by the machine's operator. Steering system 22 includes one, and preferably two, control arms or handles 28, 30 that extend beyond a shroud or cage 32 of trowel 20. Handles 28, 30 are oriented with respect to trowel 20 to be manipulated by an operator positioned in a seat 34.

Handles 28, 30 are operationally coupled to rotor assemblies 24, 26 such that manipulation of handles 28, 30 manipulates the position of rotor assembly 24, 26 relative to a frame 36 of trowel 20, respectively. In the typical case in which the machine is laterally steered by pivoting a gearbox of at least one rotor assembly about two axes, at least one of handles 28, 30 is constructed to be movable in the fore and aft directions as well as side-to-side directions. Although shown as what is commonly understood as a riding or ride-on trowel, it is appreciated that the present invention is applicable to any powered concrete finishing trowel that is steered by tilting one or more rotor assemblies with respect to a frame of the trowel. It is conceivable that walk-behind trowels could be steered in this or a similar manner.

Figure 2:
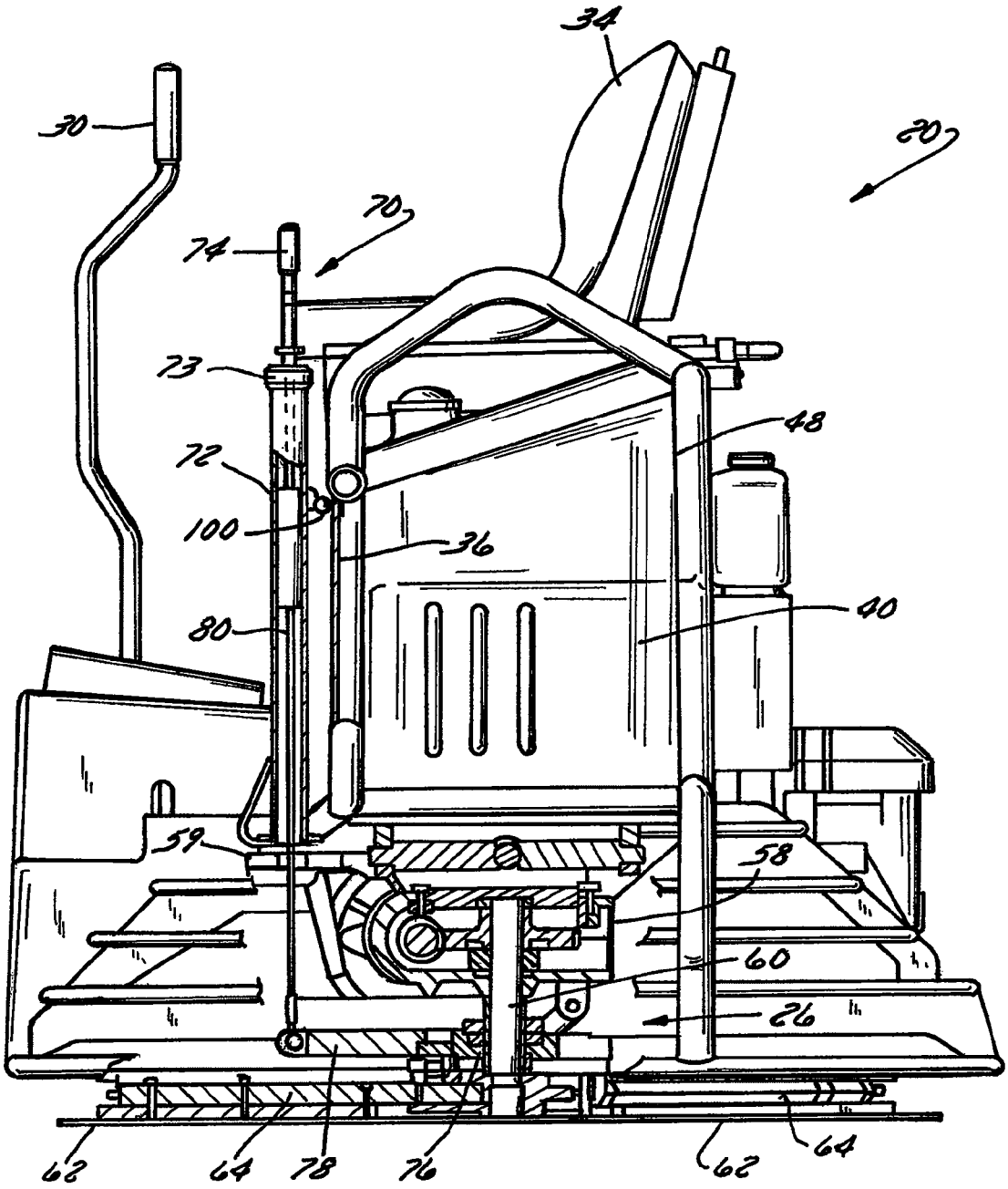
FIG. 2 is a sectional side-elevational view of the power trowel shown in FIG. 1, taken generally along the lines 2-2 in FIG. 1.

Still referring to FIGS. 1 and 2, concrete finishing trowel 20 additionally includes a rigid metallic frame 36, including a lower portion, an upper deck 38 mounted on the lower portion of the frame 36, and an operator's platform or pedestal 40 extending above the deck 38. Trowel 20 additionally includes right and left rotor assemblies 24, 26, respectively, extending downwardly from deck 38 and supporting the finishing machine 20 on the surface to be finished. The rotor assemblies 24 and 26 rotate towards the operator, or counterclockwise and clockwise, respectively, to perform a finishing operation. Cage 32 is positioned at the outer perimeter of machine 20 and extends downwardly from frame 36 to the vicinity of the surface to be finished. The pedestal 40 is positioned generally longitudinally centrally on deck 38 at a rear portion thereof and supports operator's seat 34. A fuel tank 44 is disposed adjacent the left side of pedestal 40, and a water retardant tank 46 is disposed on the right side of pedestal 40. A lift cage assembly 48 is attached to the upper surface of the deck 38 beneath pedestal 40 and seat 34.

Referring to FIGS. 1 and 2, each rotor assembly 24, 26 includes a gearbox 58, a driven shaft 60 extending downwardly from the gearbox, and a plurality of circumferentially-spaced blades 62 supported on the driven shaft 60 via radial support arms 64 and extending radially outwardly from the bottom end of the driven shaft 60 so as to rest on the concrete surface. Each gearbox 58 is mounted on the undersurface of the deck 38 so as to be tiltable relative to deck 38 and frame 36 to steer the machine as detailed below.

The pitch of the blades 62 of each of the right and left rotor assemblies 24 and 26 can be individually adjusted by a dedicated blade pitch adjustment assembly 70. Each blade pitch adjustment assembly 70 includes a generally vertical post 72 and a crank 74 which is mounted on top of the post 72, and which can be rotated by an operator positioned in seat 34 to vary the pitch of the trowel blades 62. In the typical arrangement, a thrust collar 76 cooperates with a yoke 78 that is movable to force the thrust collar 76 into a position pivoting trowel blades 62 about an axis extending perpendicular to the axis of the driven shaft 60. A tension cable 80 extends from the crank 74, through the post 72, and to the yoke 78 to interconnect the yoke 78 with the crank 74. Rotation of the crank 74 adjusts the yoke's angle to move the thrust collar 76 up or down thereby providing a desired degree of trowel blade pitch adjustment. The pitch of blades 62 is often varied as the material being finished sets and becomes more resistant to being worked by the blades. Importantly for the purposes of the present invention, each pitch post 72 is mounted on top of a pivot plate 59 of the associated gearbox 58 and, as such, is rigidly coupled to the gearbox. It is therefore subject to the same vibrations as the gearbox. Conversely, any structure that dampens vibrations of the pitch posts also dampens vibrations of the gearboxes.

Both rotor assemblies 24 and 26, as well as other powered components of the finishing trowel 20, are driven by a power source such as internal combustion engine 42 mounted under operator's seat 34. The size of engine 42 will vary with the size of the machine 20 and the number of rotor assemblies powered by the engine. The illustrated two-rotor 48" machine typically will employ an engine of about 35 hp. Rotor assemblies 24 and 26 are connected to engine 42 and can be tilted for steering purposes via steering system 22.

As is typical of riding concrete finishing trowels of this type, the machine 20 is steered by tilting a portion or all of each of the rotor assemblies 24 and 26 so that the rotation of the blades 62 generates horizontal forces that propel machine 20. The steering direction is generally perpendicular to the direction of rotor assembly tilt. Hence, side-to-side and fore-and-aft rotor assembly tilting cause machine 20 to move forward/reverse and left/right, respectively. The most expeditious way to effect the tilting required for steering control is by tilting the entire rotor assemblies 24 and 26, including the gearboxes 58. The discussion that follows therefore will describe a preferred embodiment in which the entirety of gearboxes 58 tilt. It is understood that the invention is equally applicable to systems in which other components of the rotor assemblies 24 and 26 also tilt for steering control.

More specifically, the machine 20 is steered to move forward by tilting the gearboxes 58 laterally to increase the pressure on the inner blades of each rotor assembly 24, 26 and is steered to move backwards by tilting the gearboxes 58 laterally to increase the pressure on the outer blades of each rotor assembly 24, 26. Crab or side-to-side steering requires tilting of only one gearbox (the gearbox of the right rotor assembly 24 in the illustrated embodiment), with forward tilting of right rotor assembly 24 increasing the pressure on the front blades of the rotor assembly 24 to steer the machine 20 to the right. Similarly, rearward tilting of rotor assembly 24 increases the pressure on the back blades of the rotor assembly 24 thereby steering machine 20 to the left.

Steering system 22 tilts the gearboxes 58 of the right and left rotor assemblies 24, 26 in response to manipulation of handles 28, 30 by the operator. Referring to FIG. 1, from the perspective of an operator positioned in seat 34, steering system 22 generally includes a right rotor steering linkage 82 and a left rotor steering linkage 84. Except for the fact that the right steering linkage contains additional components enabling left/right steering, right and left rotor steering linkages 82, 84 are generally mirror images of one another. Suitable steering linkages are, per se, well-known and will not be described herein. Those interested in the construction and operation of a preferred embodiment of suitable steering linkages and associate components should refer to co-pending and commonly assigned U.S. patent application Ser. No. 11/782,844, the subject matter of which is incorporated herein in its entirety.

Pursuant to a preferred embodiment of the invention, stabilizers 100 are operatively provided between the frame 36 and each of the gearboxes 58. Each stabilizer 100 could take a variety of forms mounted in a variety of locations. For instance, it could conceivably be mounted under the frame 36 and connected directly to the gearboxes 58. However, it has been discovered that connecting the stabilizers 100 to the pitch control posts 72 results in a mechanical advantage that heightens dampening effectiveness. Each stabilizer of this embodiment therefore is pivotally coupled to a structure that tilts with the associated gearbox rather than the gearbox itself. Maximization of this mechanical advantage would counsel for connecting the stabilizers 100 to the pitch control posts 72 as close as possible to the tops 73 of the pitch control posts 72. However, it has been discovered that the stabilizers 100 are most effective when mounted in or near a horizontal plane. As such, each stabilizer 100 is mounted as close as practical to the upper end of the pedestal 40 of the frame 36 and is connected to the associated pitch control post 72. This location is about 7" below the top of the pitch control posts and about 18.75" above the gear box pivot point.

Each stabilizer 100 may comprise any variable length device that compresses or extends to resist side-to-side movement of the associated pitch control post and, hence, of the associated rotor assembly. A variety of structures could be suitable for this purpose. For instance, each stabilizer 100 could take the form of one or more hydraulic shocks and/or one or more elastomeric cushions. Shocks or dampeners have been found to work best. In the illustrated preferred embodiment, however, each stabilizer takes the form of a so-called "gas spring." As is generally known, a gas spring is a piston-and-cylinder device in which the cylinder is charged with a pressurized gas, typically nitrogen, to a pressure of 1500 psi to 2500 psi. The gas biases the piston outwardly away from the cylinder but permits the piston to be forced into the cylinder under the imposition of a force above a given magnitude. The increased pressure returns the piston to its neutral position upon release of this force. Suitable gas springs are available from a variety of suppliers, including AVM Industries LLC.

Figure 3:
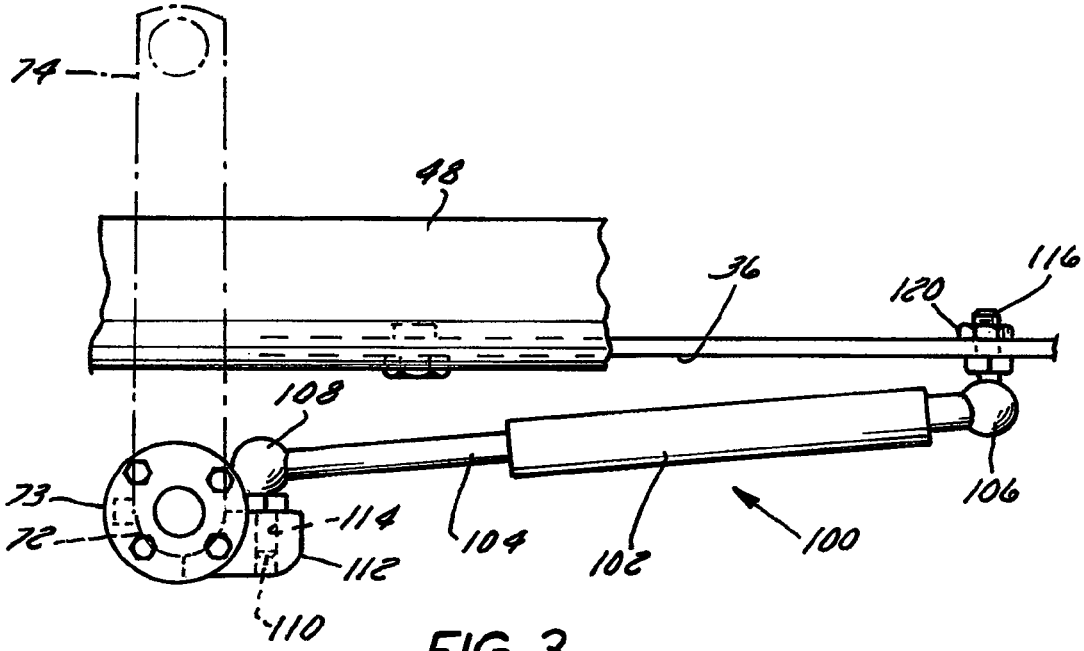
FIG. 3 is a fragmentary top plan view of a portion of the riding trowel of FIGS. 1 and 2 that includes one of the stabilizers.
Figure 4:
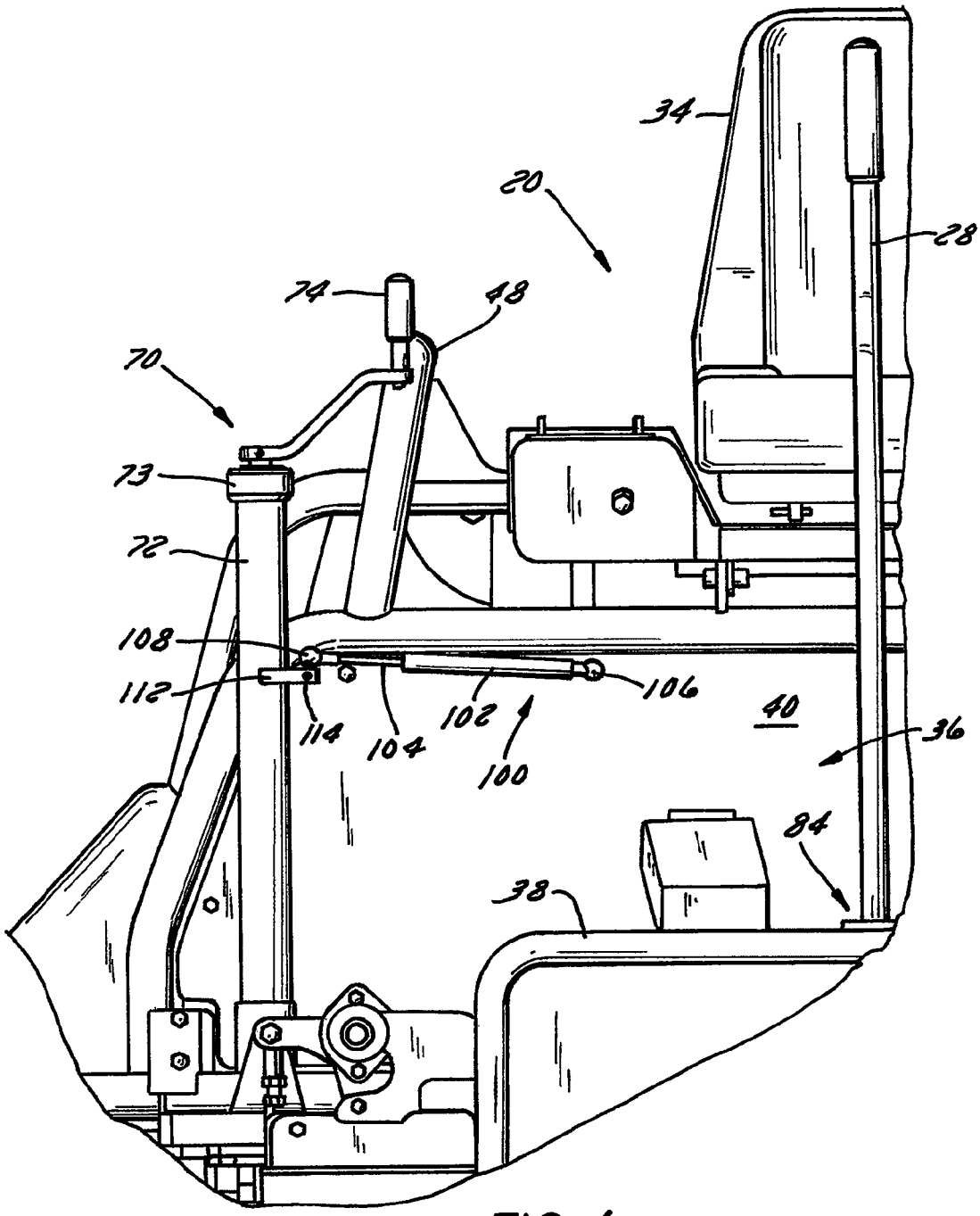
FIG. 4 is a fragmentary side elevational view of a portion of the riding trowel of FIGS. 1 and 2 that includes one of the stabilizers.
Figure 5:
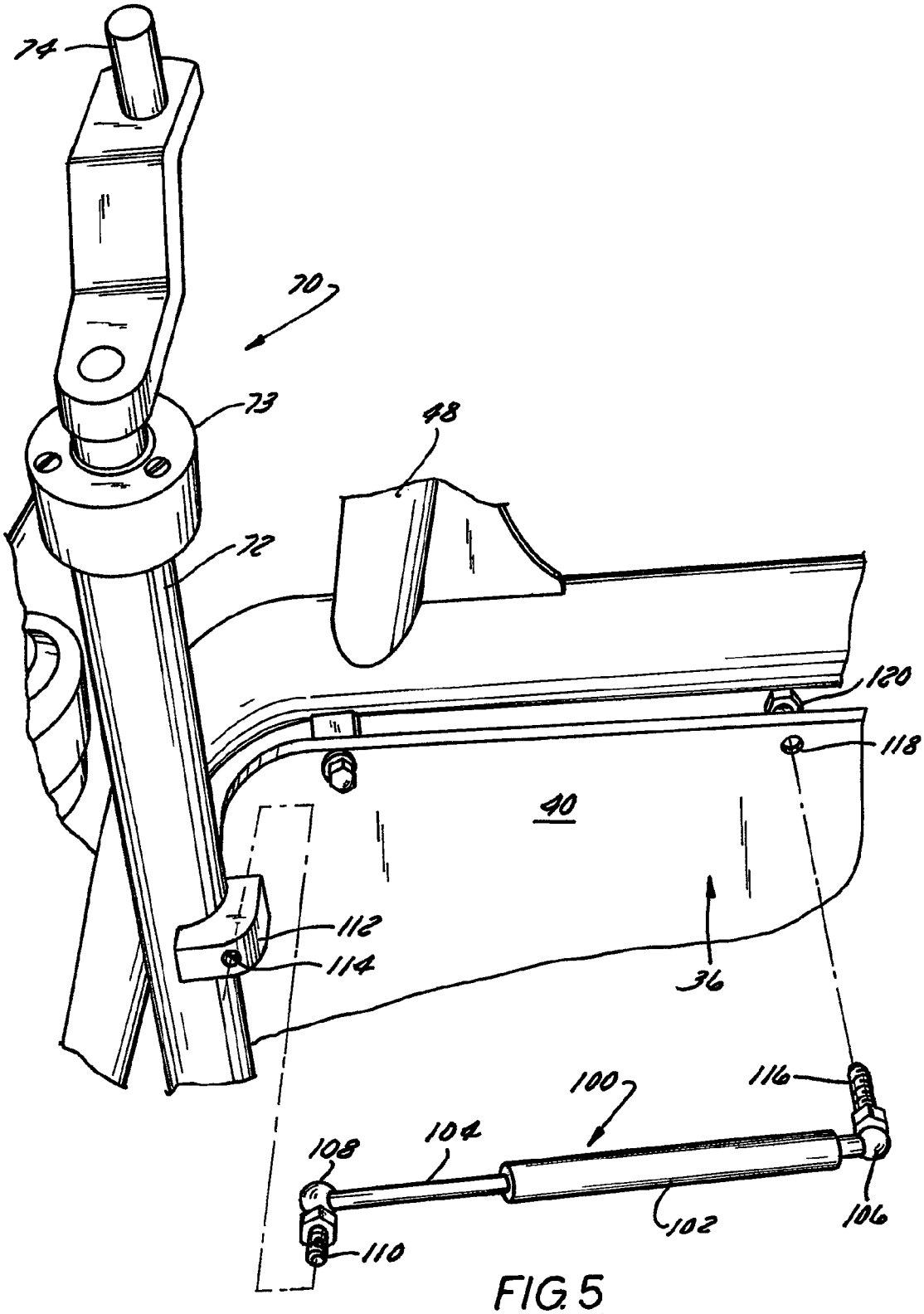
FIG. 5 is an exploded perspective view of one of the stabilizers of the trowel.

In this embodiment, the stabilizers 100 are identical to one another and mounted on pedestal 40 of frame 36 in a mirror-image fashion. The right stabilizer will now be described with references to FIGS. 3-5, it being understood that the description applies equally to the left stabilizer.

The right stabilizer 100 comprises a gas spring of the type described above. It includes a gas-filled cylinder 102 and a piston rod 104 extending from the cylinder 102. One of the piston rod 104 and the cylinder 102 is mounted to the frame 36, and the other is mounted to the pitch control post 72. In the illustrated embodiment, the cylinder 102 is mounted on the frame 36, and the piston rod 104 is mounted on the pitch control post 72 at a location about 7" below the top of the pitch control post and about 18.75" above the gear box pivot point. Preferably, each stabilizer 100 is oriented such that the piston rod 104 is mounted to frame 36 and cylinder 72 is mounted to the pitch control post 72. More preferably, the piston rod 104 of each stabilizer 100 is oriented at a downward inclination relative to the cylinder to ensure lubrication of the piston rod and cylinder seals.

Referring back to FIGS. 3-5, the gas spring 100 is about 12" long when in the state shown, which is the case when the pitch post 72 is not subject to vibrations but the gas spring 100 is slightly compressed to impede a biasing force on the pitch control post 72. The piston cylinder 102 and piston rod 104 each have a free end coupled to a respective ball joint 106, 108. The ball joint 108 on the piston rod 104 is affixed to a threaded stud 110 screwed into a tapped bore 114 in a bracket 112 welded on or otherwise affixed to an inboard side of the pitch post 72. The ball joint 106 on the cylinder 102 is affixed to a threaded stud 116 that protrudes through a hole 118 in the frame 36 and that is affixed to the frame 36 by a nut 120.

In operation, the gas springs 100 have been found to reduce both vibrations and their transmission to the frame 36 beyond expectations. Based on his knowledge of riding concrete finishing trowels and his research into the stick-slip phenomenon, the inventor would have expected vibrations, as measured by oscillation of the upper ends 73 of the pitch control posts 72, to be reduced by no more than 50% by installation of the gas springs 100 in the manner shown. Tests have shown that, in a Wacker Corporation 48" trowel operating at a blade pitch of about 3°, the vibrations were reduced by considerably more than 50% and even more than 75%. In fact, the top 73 of the pitch control posts 72 oscillated less than ⅛" with the stabilizers 100 installed and about 1" without the stabilizers. Comparable improvements were observed throughout the blade pitch and rotor operating speed ranges of the trowel 20. These reductions were much higher than anticipated prior to installation of the stabilizers 100. A partial explanation for the unexpected magnitude of improvement might be that the rotor assemblies 24 and 26 oscillate equally and oppositely, increasing the severity of the vibrations in the machine during chatter. However, the resistance of the stabilizers 100 is also equal and opposite, so the damping effect is also cumulative. The benefits of the preferred embodiment of the stabilizers can be better appreciated with the comparative data as set forth in Table 1 below and in FIG. 6.

TABLE I

BLADE CHATTER COMPARISON

| Blade Pitch (deg.) | Wacker 48" Trowel Without Stabilizer Displacement (in) | Wacker 48" Trowel with Stabilizer Displacement (in.) | Whiteman 48" Trowel Displacement (in.) |
|---|---|---|---|
| 0 | 2.03 | 0.07 | 1.22 |
| 0.5 | 0.99 | 0.12 | 1.26 |
| 1.4 | 0.60 | 0.32 | 1.27 |
| 2.2 | 1.17 | 0.41 | 1.03 |
| 2.9 | 1.28 | 0.43 | 1.58 |
| 3.6 | 0.87 | 0.06 | 1.30 |
| 4.1 | 0.22 | 0.00 | 0.08 |
| 4.6 | 0.10 | 0.00 | 0.00 |

Figure 6:
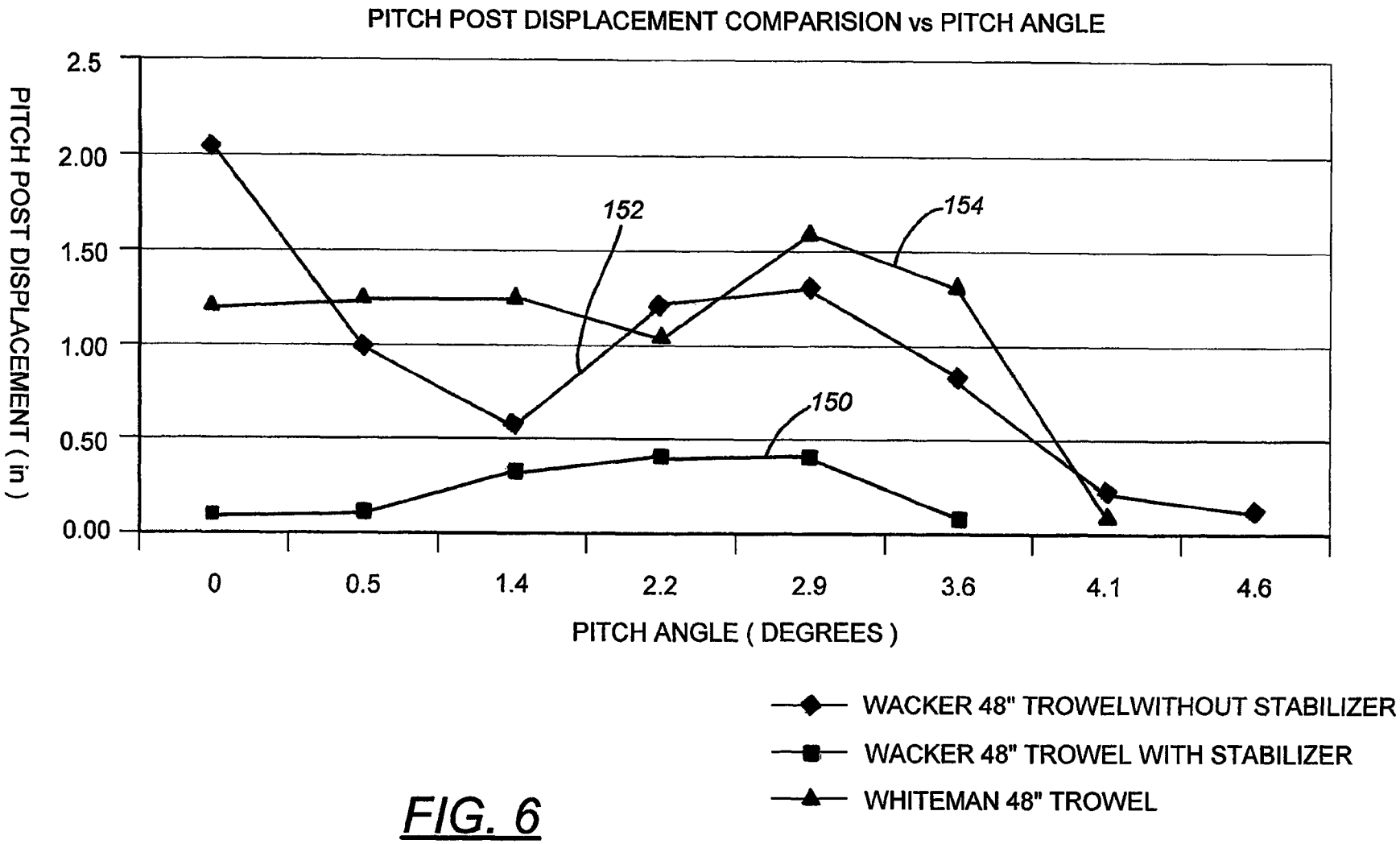
FIG. 6 is a graph comparing chatter in a concrete finishing trowel equipped with stabilizers in accordance with the present invention in trowels lacking stabilizers

As can be seen from Table 1 and a comparison of curve 150 to curves 152 and 154 in FIG. 6, chatter in a Wacker 48" trowel having stabilizers 100, as measured by pitch post displacement, is dramatically reduced through a full range of pitch post displacements when compared to the same Wacker 48" trowel without the stabilizers 100 (see curve 152) and a commercial 48" trowel manufactured by Whiteman, a subsidiary of Multiquip (see curve 154). For instance, at a 0 degree blade pitch angle, incorporating the stabilizers 100 into the Wacker 48" trowel reduces chatter from 2.03" to 0.07", a 97% reduction. This magnitude of reduction was wholly unexpected. With the exception of a potentially anomalous reduction of "only" 47% at a blade pitch angle of 1.4 degrees, comparably dramatic reductions on the order of 75% to 100% were observed at all other blade pitch angles. These observations have led the inventors to conclude that incorporating stabilizers of the type described above into a riding trowel will reduce chatter, on average, by at least 50%, more typically by at least 60%, and even more typically by at least 75% or higher for a full range of blade pitch angles.

It has also been discovered that the stabilizers 100 significantly improve the system's steering responsiveness. That is, the machine 20 accelerates or turns for even very small steering lever strokes rather than requiring the operator to move the steering control levers 28 and 30 through a lost motion stroke before the machine 20 responds. While the reasons for this increased responsiveness are not entirely understood, it is known that the gas springs 100 bias the gearboxes 58 to tilt outwardly, tending to bias the machine 20 to move rearwardly. While the biasing effect is relatively small when compared to that imposed by the torsion bar disclosed in co-pending application Ser. No. 11/782,844, it is imposed at all times rather than only during forward steering of the machine 20, taking up the cumulated compliance created in the steering linkages 82 and 84 by the various pivoting linkages. As a result, the steering linkages 82 and 84 respond to steering lever operation immediately.

It is appreciated that many changes and modifications could be made to the invention without departing from the spirit thereof. Some of these changes, such as its applicability to riding concrete finishing trowels having other than two rotors and even to other self-propelled powered finishing trowels, are discussed above. Other changes will become apparent from the appended claims. It is intended that all such changes and/or modifications be incorporated in the appending claims.

What is claimed is:

1. A riding power trowel comprising:

a frame;

an operator's station supported on the frame;

at least one rotor assembly including a rotatable shaft and a plurality of blades, the rotor assembly being tiltable to steer the power trowel; and a stabilizer operatively coupled to the rotor assembly and to the frame and operative to damp transmission of vibrations to the frame from the rotor assembly by resisting side-to-side movement of the rotor assembly relative to the frame, the stabilizer having first and second ends operatively coupled to the rotor assembly and the frame, respectively, and being compressible and extensible between the first and second ends thereof in response to relative side-to-side movement between the rotor assembly and the frame.

2. The trowel as recited in claim 1, wherein the rotor assembly includes a tiltable gearbox having an output shaft connected to a driven shaft of the rotor assembly, and wherein the stabilizer is operatively coupled to the gearbox.

3. The trowel as recited in claim 2, wherein the rotor assembly further comprises a blade pitch control post mounted on the gearbox and extending upwardly through the frame, and wherein the stabilizer is connected to the blade pitch control post at one end thereof and to the frame and another end thereof.

4. The trowel as recited in claim 1, wherein the trowel comprises two counter-rotating rotor assemblies located on opposite sides of the trowel, and wherein a separate stabilizer is provided for each rotor.

5. The trowel as recited in claim 1, wherein the stabilizer reduces vibrations in the system, on average, by at least 50% for a full range of blade pitch angles.

6. The trowel as recited in claim 5, wherein the stabilizer reduces vibrations in the system, on average, by at least 60% for a full range of blade pitch angles.

7. The trowel as recited in claim 6, wherein the stabilizer reduces vibrations in the system, on average, by at least 75% for a full range of blade pitch angles.

8. The trowel as recited in claim 1, wherein the rotor assembly includes a tiltable gearbox, and wherein the stabilizer is pivotally connected to the frame and one end thereof and to a one of the gearbox and a structure that tilts with the gearbox at another end thereof.

9. The trowel as recited in claim 8, wherein the stabilizer extends at least generally horizontally.

10. The trowel as recited in claim 1, wherein the stabilizer comprises a piston-cylinder-device having a first end that is pivotally connected to the frame and a second end pivotally connected to one of the gearbox assembly and a device that moves side-to-side with the gearbox assembly.

11. A riding power trowel comprising:

a frame;

an operator's station supported on the frame;

at least one rotor assembly including a rotatable shaft and a plurality of blades, the rotor assembly being tiltable to steer the power trowel; and an at least generally horizontally extending elongated stabilizer of variable length, the stabilizer having a first end pivotally connected to a component of the the rotor assembly and having a second end that is pivotally connected to the frame and being compressible and extendible along its length such that a distance between the first and second ends varies, the stabilizer resisting movement of the rotor assembly relative to the frame by compressing and extending in response to relative movement between the frame and the rotor assembly thereby to damp transmission of vibrations to the frame from the rotor assembly.

12. The trowel as recited in claim 11, wherein the rotor assembly further comprises a gearbox and a blade pitch control post that is connected to the gearbox and that extends upwardly through the frame, and wherein the first end of the stabilizer is pivotally connected to the blade pitch control post.

13. The trowel as recited in claim 11, wherein the stabilizer comprises a piston-cylinder-device.

14. A riding power trowel comprising:

a frame;

an operator's station supported on the frame;

at least one rotor assembly including a rotatable shaft and a plurality of blades, the rotor assembly being tiltable to steer the power trowel; and a stabilizer operatively coupled to the rotor assembly and to the frame and operative to damp transmission of vibrations to the frame from the rotor assembly, wherein the stabilizer comprises a gas spring pivotally connected to the frame at one end thereof and to a component of the rotor assembly at another end thereof.

15. A method comprising:

dampening the transmissions of vibrations from a rotor assembly of riding concrete trowel to a frame thereof using a stabilizer located between and pivotally connected to the frame and the rotor assembly, the stabilizer being of variable length and extending or contracting during trowel operation to resist movement of the rotor assembly relative to the frame, wherein the stabilizer comprises a gas spring having a first end pivotally connected to the frame and a second end pivotally connected to a component of the rotor assembly.

16. A method comprising:

dampening the transmissions of vibrations from a rotor assembly of riding concrete trowel to a frame thereof using a stabilizer located between and pivotally connected to the frame and the rotor assembly, the stabilizer being elongated, having first and second ends, and being of variable length between the first and second ends thereof and extending and contracting during trowel operation to resist movement of the rotor assembly relative to the frame.

17. The method of claim 16, wherein the rotor assembly includes a tiltable gearbox having an output shaft connected to a driven shaft of the rotor assembly, and a blade pitch control post mounted on the gearbox and extending upwardly through the frame, and wherein the stabilizer is pivotally connected to the frame at a first end thereof and to the blade pitch control post at second end thereof.

18. The method as recited in claim 16, wherein the stabilizer reduces vibrations in the system, on average, by at least 50% for a full range of blade pitch angles.

19. The method as recited in claim 18, wherein the stabilizer reduces vibrations in the system, on average, by at least 60% for a full range of blade pitch angles.

20. The method as recited in claim 19, wherein the stabilizer reduces vibrations in the system, on average, by at least 75% for a full range of blade pitch angles.

21. A riding power trowel comprising:

a frame;

an operator's station supported on the frame;

at least one rotor assembly including a rotatable shaft and a plurality of blades, the rotor assembly being tiltable to steer the power trowel; and a stabilizer operatively coupled to the rotor assembly and to the frame and operative to damp transmission of vibrations to the frame from the rotor assembly, wherein the rotor assembly includes a tiltable gearbox, and wherein the stabilizer is pivotally connected to the frame and one end thereof and to a one of the gearbox and a structure that tilts with the gearbox at another end thereof, and wherein the stabilizer is of variable length and compresses or extends to resist side-to-side movement of the structure relative to the frame.

* * * * *